US007446599B1

(12) United States Patent
Wang

(10) Patent No.: US 7,446,599 B1
(45) Date of Patent: Nov. 4, 2008

(54) REFERENCE VOLTAGE GENERATOR

(75) Inventor: Hui-Min Wang, Tainan (TW)

(73) Assignee: Himax Technologies Limited, TainanCounty (TW)

( * ) Notice: Subject to any disclaimer, the term of this patent is extended or adjusted under 35 U.S.C. 154(b) by 43 days.

(21) Appl. No.: 11/806,107

(22) Filed: May 30, 2007

(51) Int. Cl.
*G05F 1/10* (2006.01)

(52) U.S. Cl. ..... 327/539; 327/540; 327/512; 323/313; 323/315

(58) Field of Classification Search ..... 327/538–540, 327/333, 512, 513; 323/312–316, 907
See application file for complete search history.

(56) References Cited

U.S. PATENT DOCUMENTS 6,727,744 B2 * 4/2004 Nagaya ..... 327/540
6,879,141 B1 * 4/2005 Ho ..... 323/315
7,116,588 B2 * 10/2006 Joo ..... 365/189.09
7,224,209 B2 * 5/2007 Hsu ..... 327/538

* cited by examiner

*Primary Examiner*—An T. Luu
(74) *Attorney, Agent, or Firm*—Bacon & Thomas, PLLC

(57) ABSTRACT

A reference voltage generator is provided. The reference voltage generator includes a bandgap reference circuit, a level shifter and a voltage divider. The bandgap reference circuit includes a current generator and a first BJT. The current generator outputs a reference current. The first BJT flows in the reference current from its emitter via a first resistor and has its collector and base grounded, such that a bandgap reference voltage and a first bias voltage can be output at the connection between the current generator and the first resistor and at the emitter of the first BJT. The level shifter is coupled to the bandgap reference circuit and outputs a second bias voltage higher than the first bias voltage and unequal to the bandgap reference voltage. The voltage divider is connected between the second bias voltage and the bandgap reference voltage and outputs a reference voltage therebetween.

9 Claims, 2 Drawing Sheets

REFERENCE VOLTAGE GENERATOR

BACKGROUND OF THE INVENTION

1. Field of the Invention

The invention relates in general to a reference voltage generator and more particularly to a reference voltage generator saving power.

2. Description of the Related Art

A conventional reference voltage generator utilizes a bandgap reference circuit to generate a PTAT (proportional to absolute temperature) bandgap reference voltage. Due to the characteristic of the bandgap reference circuit, the range of the bandgap reference voltage is limited. When a higher reference voltage is desired, the bandgap reference voltage is outputted via an extra operational amplifier. A resistor string is then used to generate a higher reference voltage according to the outputted bandgap reference voltage. However, the OP amplifier is not only very power-consuming, but also requires IC space when implemented.

SUMMARY OF THE INVENTION

The invention is directed to a reference voltage generator. The reference voltage generator according to the two embodiments outputs a reference voltage higher than a bandgap reference voltage without applying operational amplifier. The reference voltage generator is more power-efficient and only fewer IC space is required when it is implemented. Therefore, the cost of employing or manufacturing the reference voltage generator is reduced effectively.

According to (a first aspect of) the present invention, a reference voltage generator is provided. The reference voltage generator includes a bandgap reference circuit, a level shifter and a voltage divider. The bandgap reference circuit includes a current generator and a first BJT. The current generator outputs a reference current. The first BJT flows in the reference current from its emitter via a first resistor and has its collector and base grounded, such that a bandgap reference voltage and a first bias voltage can be output at the connection between the current generator and the first resistor and at the emitter of the first BJT. The level shifter is coupled to the bandgap reference circuit and outputs a second bias voltage higher than the first bias voltage and unequal to the bandgap reference voltage. The voltage divider is connected between the second bias voltage and the bandgap reference voltage and outputs a reference voltage therebetween.

The invention will become apparent from the following detailed description of the preferred but non-limiting embodiments. The following description is made with reference to the accompanying drawings.

DETAILED DESCRIPTION OF THE INVENTION

Figure 1:
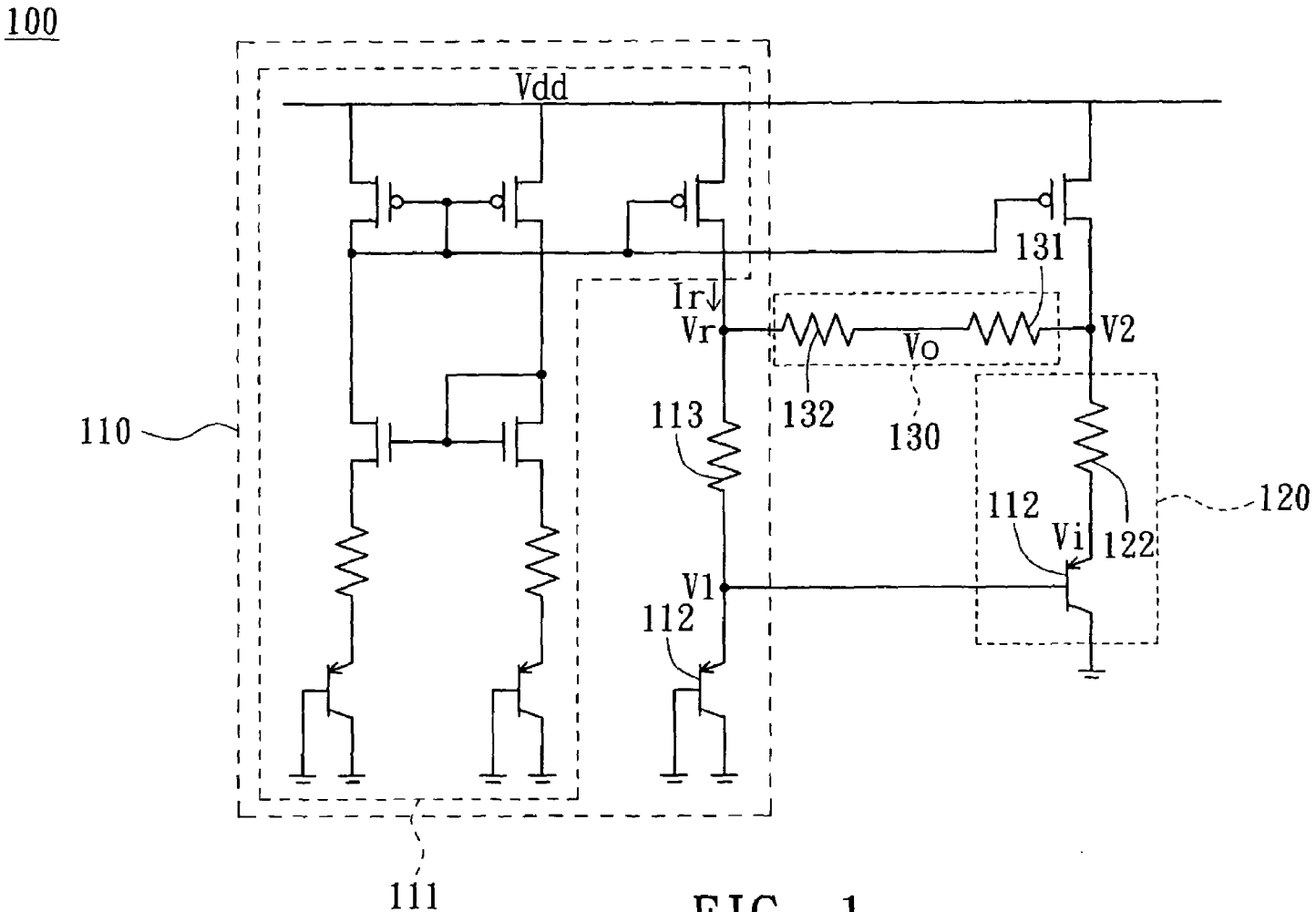
FIG. 1 is a circuit diagram of a reference voltage generator in accordance with an embodiment of the invention.

FIG. 1 is a circuit diagram of a reference voltage generator according to the embodiment of the invention. Refer to FIG. 1. The reference voltage generator 100 includes a bandgap reference circuit 110, a level shifter 120 and a voltage divider 130. The bandgap reference circuit includes a current generator 111 and a BJT 112. The current generator 111 is for outputting a reference current Ir. The reference current Ir is flowed into the emitter of the BJT 112 via a resistor 113. The BJT 112 has its base and its collector grounded. A first bias voltage V1 is output at the emitter of the BJT 112. A bandgap reference voltage Vr is output at the connection between the current generator 111 and the resistor 113.

The level shifter 120 is coupled to the bandgap reference circuit 110 and is used for generating a bias voltage V2 higher than the bias voltage V1 and unequal to the bandgap reference voltage Vr. The voltage divider 130 is connected between the bias voltage V2 and the bandgap reference voltage Vr and outputting a reference voltage Vo therebetween.

In the embodiment, the level shifter includes a BJT 112 and a resistor 122. The BJT 112 has its base coupled to the emitter of the BJT 112 for receiving the bias voltage V1 and its collector grounded so as to output an internal voltage Vi higher than the bias voltage V1 at its collector. The resistor 122 receives the internal voltage Vi at its one end and outputs the bias voltage V2 at its another one end.

The voltage divider 130 can be a high-impedance resistor string or a high-impedance variable resistor. In this embodiment, the high-impedance string includes the resistor 131 and 132 to divide the voltage between the bandgap reference voltage Vr and the bias voltage V2 so as to output the reference voltage Vo. The resistances of the resistor 131 and 132 are adjustable for outputting the appropriate reference voltage.

The current generator 110 is a PTAT (proportional to absolute temperature) current generator. The bandgap reference voltage Vr output by the bandgap reference circuit 110 exhibits little dependence on the environment temperature. In the embodiment, by adjusting the resistance of the resistor 122, the level shifter 120 can preferably outputs the bias voltage V2 twice as the bandgap reference voltage Vr, such that the reference voltage Vo is sufficiently insensitive to the environment temperature.

For example, the bandgap reference voltage Vr output by the bandgap reference circuit 110 is usually around 1.25V. The bias voltage V2 generated by the level shifter 120 is around 2.5V, which is twice higher than the bandgap reference voltage, by adjusting the resistance of the resistor 122. The reference voltage Vo is obtain between 1.25V and 2.5V, which is sufficiently insensible to the environment temperature.

The reference voltage generator according to the embodiment outputs a reference voltage higher than a bandgap reference voltage without applying operational amplifier. Only four current paths are required in the circuit. Therefore, the reference voltage generator consumes less power and requires less IC space when it is implemented in comparison to the conventional reference voltage generator.

Figure 2:
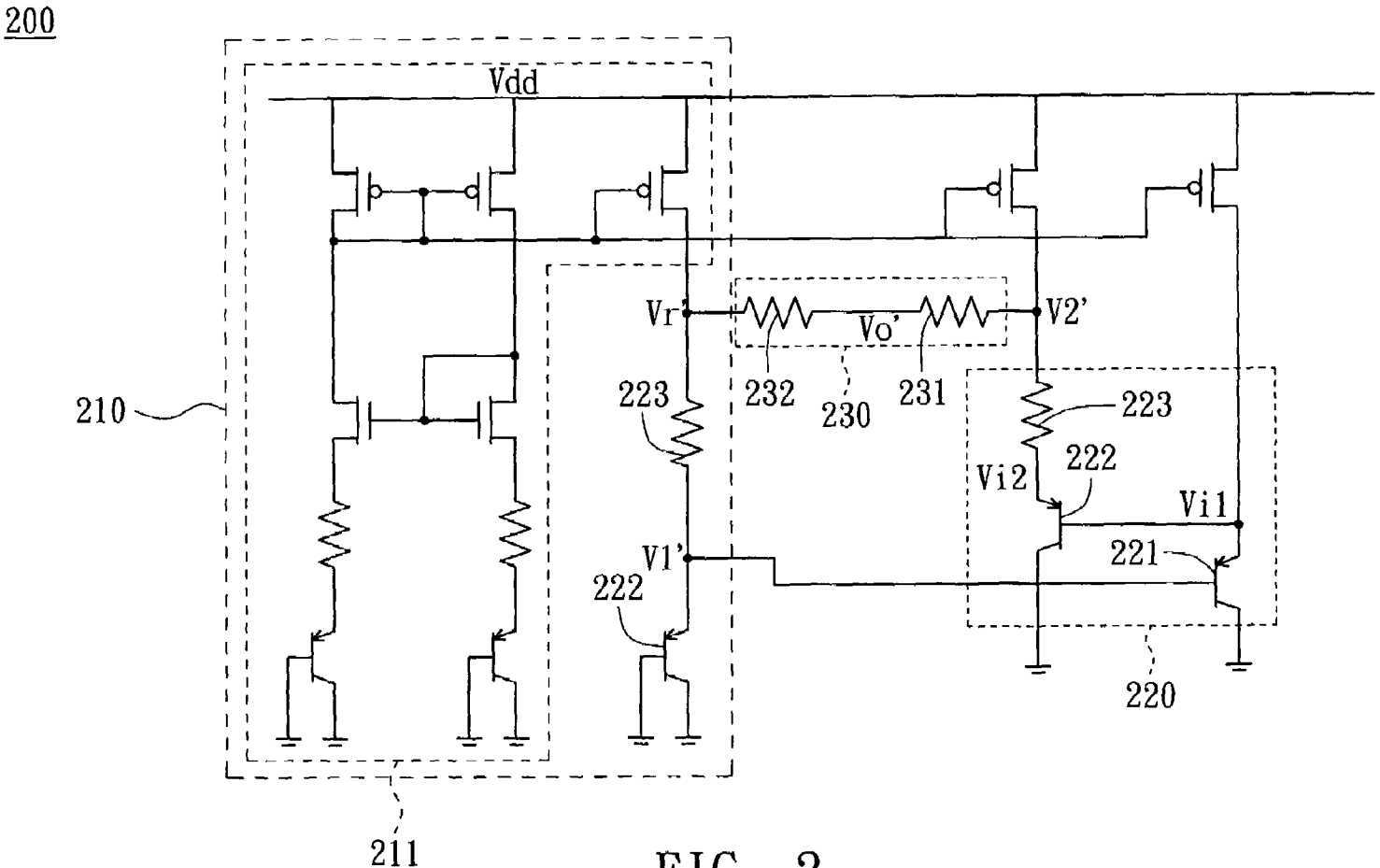
FIG. 2 is a circuit diagram of a reference voltage generator in accordance with another embodiment of the invention.

The reference voltage generator in the invention can be designed to generate higher reference voltage. FIG. 2 is a circuit diagram of a reference voltage generator according to anther embodiment of the invention. Refer to FIG. 2. The reference voltage generator 200 is used to generate a reference voltage Vo' higher than the reference voltage Vo generated by the reference voltage generator 100. The reference voltage generator 200 differs from the reference voltage generator 100 in the level shifter 220 and its supply voltage VDD.

The level shifter 220 includes BJTs 221, 222 and a resistor 223. The BJT 221 has its base coupled to the emitter of the BJT 222 for receiving the bias voltage V1' and its collector grounded to output an internal voltage Vi1 higher than the bias voltage V1' at its collector.

The BJT 222 has its base coupled to the emitter of the BJT 221 for receiving the internal voltage Vi1 and its collector grounded to output an internal voltage Vi2 higher than the internal voltage Vi1 at its collector.

The resistor 223 receives the internal voltage Vi2 at its one end to output the bias voltage V2' at another one end. The voltage divider 230 divides the voltage between the bandgap reference voltage Vr' and the bias voltage V2' and outputs the reference voltage Vo'.

Since the bias voltage V2' is obtained via two emitter-base cross voltages of the BJTs 221 and 222, the bias voltage V2' is higher than the bias voltage V2 in the reference voltage generator 100, which is obtained via one emitter-base cross voltage of the BJT 121. Therefore, the reference voltage Vo' can be generated higher than the reference voltage Vo.

The supply voltage VDD is higher than the supply voltage Vdd applied in the reference voltage generator 100 for generating the bias voltage V2' higher than the bias voltage V2.

Likewise, the current generator 210 is a PTAT current generator. The bandgap reference voltage Vr' exhibits little dependence on the environment temperature. In the embodiment, by adjusting the resistance of the resistor 223, the level shifter 220 can preferably outputs the bias voltage V2' three times higher than the bandgap reference voltage Vr', such that the reference voltage Vo' is sufficiently insensitive to the environment temperature.

For example, the bandgap reference voltage Vr' output by the bandgap reference circuit 110 is around 1.25V. The bias voltage V2 generated by the level shifter 120 is adjusted to be around 3.75V, which is three times higher than the bandgap reference voltage. The reference voltage Vo is obtain between 1.25V and 3.75V, which is more suitable to some application and also sufficiently insensible to the environment temperature.

The level shifters 120 and 220 respectively employ one and two BJT to obtain higher bias voltage V2 and V2' so as to generate higher reference voltage. In practical use, more BJT can be applied in the level shifter so as to generate a higher reference voltage. The bias voltage output by the level shifter can be N times higher than the bandgap reference voltage such that the reference voltage is PTAT, where N is an integer.

The reference voltage generator according to the two embodiments outputs a reference voltage higher than a bandgap reference voltage without applying operational amplifier. The reference voltage generator is more power-efficient and only fewer IC space is required when it is implemented. Therefore, the cost of employing or manufacturing the reference voltage generator is reduced effectively.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A reference voltage generator comprising:

a bandgap reference circuit comprising:

a current generator outputting a reference current; and a first BJT flowing in the reference current from its emitter via a first resistor and having its collector and base grounded, such that a bandgap reference voltage and a first bias voltage can be output at the connection between the current generator and the first resistor and at the emitter of the first BJT;

a level shifter coupled to the bandgap reference circuit and outputting a second bias voltage higher than the first bias voltage and unequal to the bandgap reference voltage; and a voltage divider connected between the second bias voltage and the bandgap reference voltage and outputting a reference voltage therebetween.

2. The reference voltage generator according to claim 1, wherein the level shifter comprises:

a second BJT having its base receiving the first bias voltage and its collector grounded to output an internal voltage higher than the first bias voltage at its collector;

a second resistor receiving the internal voltage at its one end to output the second bias voltage at its the other one end.

3. The reference voltage generator according to claim 2, wherein the first bias voltage is twice higher than the bandgap reference voltage.

4. The reference voltage generator according to claim 1, wherein the level shifter comprises:

a second BJT having its base receiving the first bias voltage and its collector grounded to output a first internal voltage higher than the first bias voltage at its collector;

a third BJT having its base receiving the first internal voltage and its collector grounded to output a second internal voltage higher than the first internal voltage at its collector;

a second resistor receiving the second internal voltage at its one end to output the second bias voltage at its another one end.

5. The reference voltage generator according to claim 4, wherein the first bias voltage is three times higher than the bandgap reference voltage.

6. The reference voltage generator according to claim 1, wherein the voltage divider is a high-impedance resistor string.

7. The reference voltage generator according to claim 1, wherein the voltage divider is a high-impedance variable resistor.

8. The reference voltage generator according to claim 1, wherein the current generator is a PTAT (proportional to absolute temperature) current generator.

9. The reference voltage generator according to claim 1, wherein the second bias voltage is N times higher than the bandgap reference voltage such that the reference voltage is PTAT.

* * * * *